US008337226B2

(12) United States Patent
Yokoo

(10) Patent No.: US 8,337,226 B2
(45) Date of Patent: Dec. 25, 2012

(54) CONNECTOR

(75) Inventor: Hiroyuki Yokoo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 13/211,573

(22) Filed: Aug. 17, 2011

(65) Prior Publication Data

US 2012/0045919 A1 Feb. 23, 2012

(30) Foreign Application Priority Data

Aug. 18, 2010 (JP) ..... 2010-183419

(51) Int. Cl.
*H01R 12/24* (2006.01)

(52) U.S. Cl. ..... 439/260

(58) Field of Classification Search ..... 439/495, 439/492–494, 496–499, 260, 345
See application file for complete search history.

(56) References Cited

U.S. PATENT DOCUMENTS

| | | | | |
|---|---|---|---|---|
| 6,652,322 | B2 * | 11/2003 | Ito et al. | 439/637 |
| 7,040,917 | B2 * | 5/2006 | Yagi et al. | 439/495 |
| 7,112,079 | B2 * | 9/2006 | Miura et al. | 439/260 |
| 7,544,087 | B2 * | 6/2009 | Homer et al. | 439/492 |
| 7,833,041 | B2 * | 11/2010 | Ono et al. | 439/329 |
| 7,909,630 | B2 * | 3/2011 | Yamada | 439/260 |
| 2002/0045374 | A1 * | 4/2002 | Kunishi et al. | 439/260 |
| 2002/0119704 | A1 * | 8/2002 | Ito et al. | 439/636 |
| 2004/0002254 | A1 | 1/2004 | Tsunematsu | |

FOREIGN PATENT DOCUMENTS

| | | | |
|---|---|---|---|
| JP | 2004-39321 | A | 2/2004 |
| JP | 2006-079853 | A | 3/2006 |

* cited by examiner

*Primary Examiner* — Neil Abrams
*Assistant Examiner* — Phuongchi Nguyen
(74) *Attorney, Agent, or Firm* — Holtz, Holtz, Goodman & Chick, PC

(57) ABSTRACT

A connector is configured to be connected to a connecting object. The connector comprises a housing, an actuator, an upper contact and a lower contact. The actuator has a lift-up portion and is held by the housing so as to be pivotable between an open position and a close position. The upper contact and the lower contact are held by the housing. The connecting object is accommodated between the upper contact and the lower contact when the actuator is located at the open position. When the actuator is pivoted and located at the close position, the lift-up portion forces an end of the upper contact to move so that an opposite end of the upper contact presses the connection object downward. Then, the connection object forces an end of the lower contact to move so that an opposite end of the lower contact presses the connection object upward.

7 Claims, 4 Drawing Sheets

CONNECTOR

CROSS REFERENCE TO RELATED APPLICATIONS

Applicants claim priority under 35 U.S.C. §119 of Japanese Patent Application No. JP 2010-183419 filed Aug. 18, 2010.

BACKGROUND OF THE INVENTION

This invention relates to a connector which is configured to be connected to a sheet-like or a board-like connecting object. For example, the connecting object is a FFC (Flexible Flat Cable) or a FPC (Flexible Printed Circuit).

For example, a connector of this type is disclosed in JP-A 2004-39321, contents of which are incorporated herein by reference. The connector of JP-A 2004-39321 has an actuator and a plurality of contacts. Three different parts of the contact are configured to be elastically brought into contact with a connecting object when the actuator is located at a close position. At least one of the three parts of the contact is pressed against an upper surface of the connecting object while at least a remaining one of the three parts is pressed against a lower surface of the connecting object. As for the connector of JP-A 2004-39321, any one of the three parts of the contact can be used as a contact point with the connecting object so that it is possible to design and arrange contact points of the connecting object in a less restrictive manner.

Each of the contacts of the connector of JP-A 2004-39321 is required to have three different contact points. As a result, even if the connecting object is configured to be brought into contact with only one of the contact points of the contact, the connecting object is required to have three contact points corresponding to the contact points for each of the contacts. Thus, the connector of JP-A 2004-39321 has a problem that it is difficult to use an area of the connecting object efficiently.

SUMMARY OF THE INVENTION

It is therefore an object of the present invention to provide a connector which is configured to be connected to a connecting object in a manner that an area of the connecting object is able to be used efficiently.

One aspect of the present invention provides a connector configured to be connected to a connecting object having an upper surface and a lower surface. The connector comprises a housing, an actuator held by the housing so as to be pivotable between an open position and a close position, an upper contact held by the housing and a lower contact which is other than the upper contact and is held by the housing. The actuator has a lift-up portion. The upper contact has an upper arm and an upper support portion. The upper arm has an upper pressed portion formed on one of ends thereof and an upper contact portion formed on a remaining one of ends thereof. The upper support portion is connected to a middle part of the upper arm between the upper pressed portion and the upper contact portion. The lower contact has a lower arm and a lower support portion. The lower arm has a lower pressed portion formed on one of ends thereof and a lower contact portion formed on a remaining one of ends thereof. The lower support portion is connected to a middle part of the lower arm between the lower pressed portion and the lower contact portion. The upper contact portion is located above the lower pressed portion. The upper arm and the lower arm are arranged so as to be able to accommodate the connecting object in an accommodating portion formed therebetween when the actuator is located at the open position. When the actuator is located at the closed position in a state that the connecting object is accommodated in the accommodating portion, the lift-up portion lifts up the upper pressed portion to move the upper contact portion downward so that the upper contact portion is brought into contact with and pressed against the upper surface of the connecting object, and the connecting object pressed downward by the upper contact portion pushes down the lower pressed portion to move the lower contact portion upward so that the lower contact portion is brought into contact with and pressed against the lower surface of the connecting object.

Another aspect of the present invention provides a connector assembly. The connector assembly comprises the connector as described above, a connecting object connectable to the connector and a holding member configured to hold the connecting object. The connecting object has an upper surface, a lower surface and a ground terminal.

An appreciation of the objectives of the present invention and a more complete understanding of its structure may be had by studying the following description of the preferred embodiment and by referring to the accompanying drawings.

Figure 1:
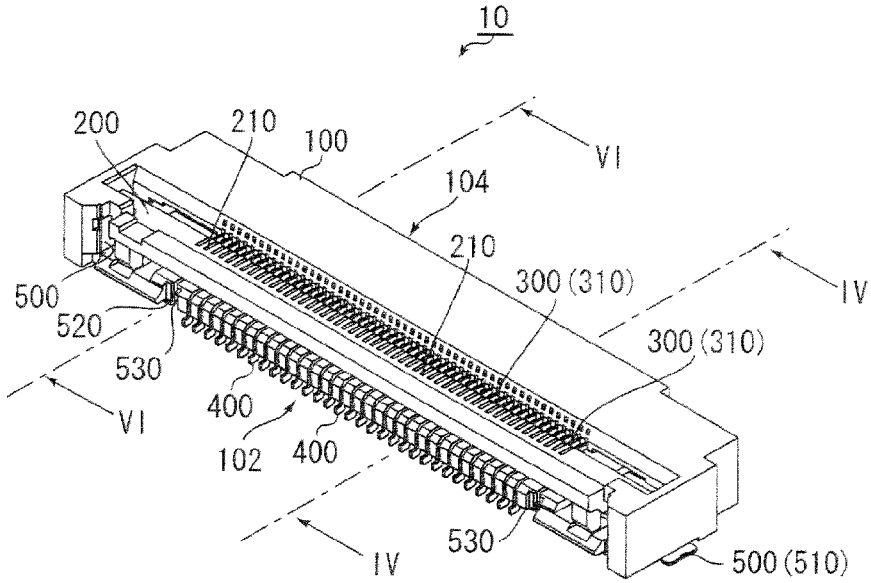
FIG. 1 is a front oblique view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIGS. 1 to 6, a connector assembly according to an embodiment of the present invention comprises a connector 10, an FPC/FFC 50 (connecting object) connectable to the connector 10 and a holding member 80 configured to hold the FPC/FFC 50 (connecting object). The connector 10 according to the present embodiment extends long in the width direction of the connector 10. The connector 10 is configured to be connected to the FPC/FFC 50 held by the holding member 80.

Figure 3:
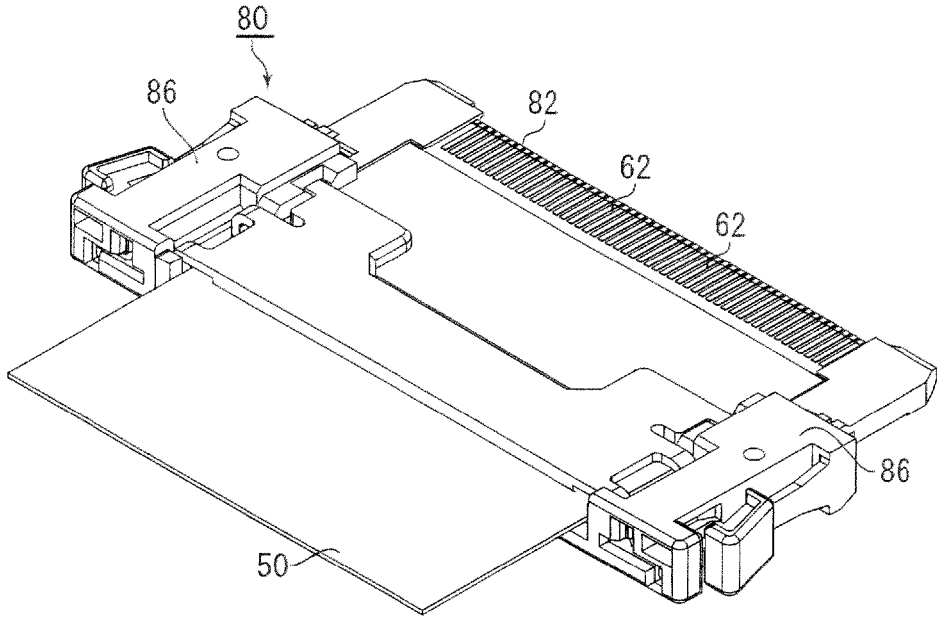
FIG. 3 is a perspective view showing a connecting object connectable to the connector of FIG. 1 and a holding member holding the connecting object.
Figure 5:
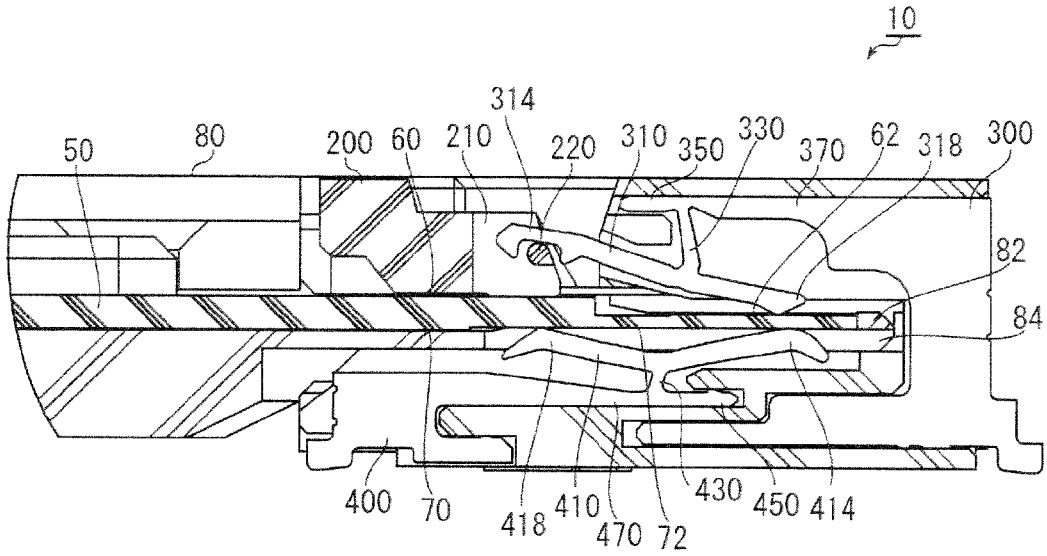
FIG. 5 is a cross-sectional view showing the connector of FIG. 1, taken along lines IV-IV, wherein the actuator is located at a close position while the connecting object is inserted in the connector.
Figure 6:
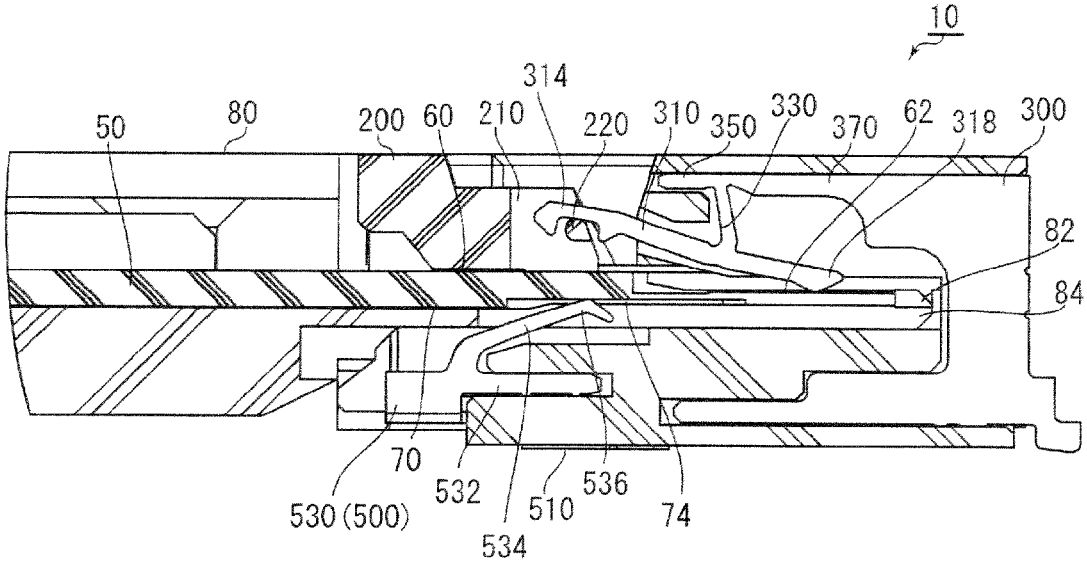
FIG. 6 is a cross-sectional view showing the connector of FIG. 1, taken along lines VI-VI, wherein the actuator is located at the close position while the connecting object is inserted in the connector.

Referring to FIGS. 3, 5 and 6, the FPC/FFC 50 is provided with a base sheet made of an insulating material. The FPC/FFC 50 has an upper surface 60 and a lower surface 70. The upper surface 60 is formed with a plurality of upper terminals 62. The lower surface 70 is formed with a plurality of lower terminals 72 and two ground terminals 74. The lower terminals 72 are arranged between the ground terminals 74 in the width direction.

Referring to FIGS. 3, 5 and 6, the FPC/FFC 50 is inserted in and held by the holding member 80 made of an insulating material. The holding member 80 has a tip portion 82 and a plurality of grooves 84 formed on a lower surface of the tip portion 82. Each of the lower terminals 72 and the ground terminals 74 is contactable from the outside through the corresponding groove 84. The holding member 80 further has handling portions 86 formed on opposite sides thereof in the width direction. According to the present embodiment, it is possible to hold the handling portions 86 with both hands so as to insert the tip portion 82 of the holding member 80 into the connector 10. Therefore, the FPC/FFC 50 may be handled more easily than a case that the FPC/FFC 50 is inserted into the connector 10 without being held by the holding member 80. The upper terminals 62, the lower terminals 72 and the ground terminals 74 of the FPC/FFC 50 are protected by the tip portion 82 while being contactable from the outside. Therefore, the FPC/FFC 50 held by the holding member 80 is more unlikely to be damaged than the FPC/FFC 50 not held by the holding member 80.

Referring to FIGS. 1, 2, 4 and 6, the connector 10 according to the present embodiment comprises a housing 100 made of an insulating material, an actuator 200 made of an insulating material, a plurality of the upper contacts 300 each of which is made of a metal, a plurality of the lower contacts 400 each of which is made of a metal and a plurality of hold-downs 500 each of which is made of a metal. As can be seen from FIGS. 4 to 6, according to the present embodiment, the lower contact 400 is another member than the upper contact 300.

Figure 4:
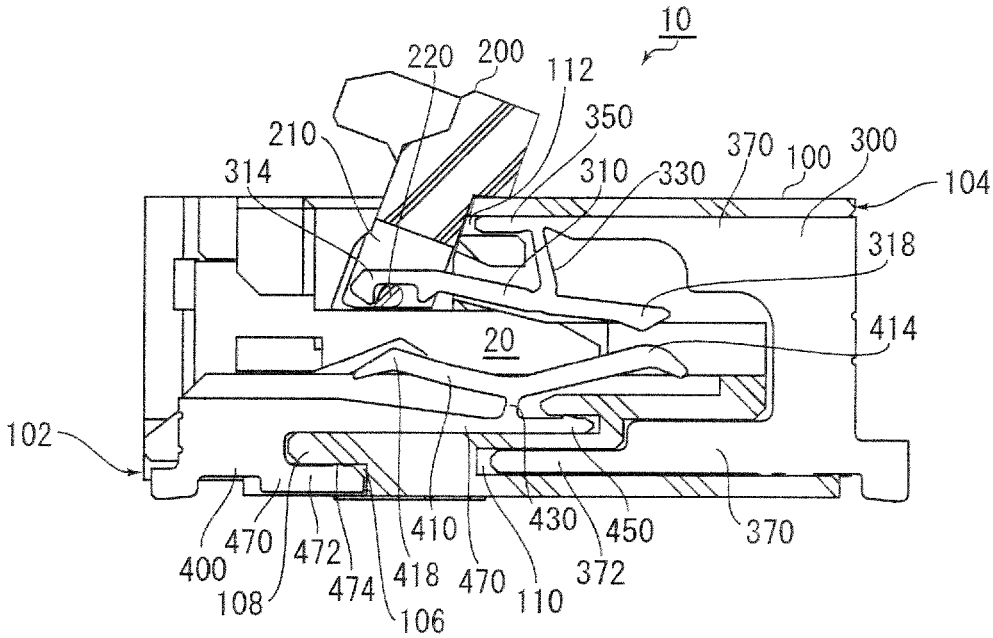
FIG. 4 is a cross-sectional view showing the connector of FIG. 1, taken along lines IV-IV, wherein an actuator of the connector is located at an open position.

Referring to FIG. 4, the housing 100 has a front end 102 and a rear end 104.

Figure 7:
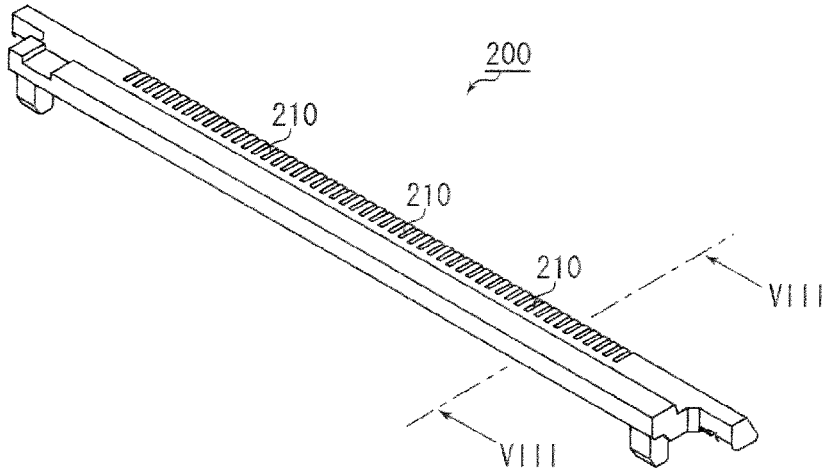
FIG. 7 is a perspective view showing the actuator of the connector of FIG. 1.
Figure 8:
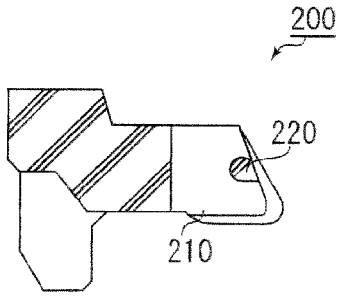
FIG. 8 is a cross-sectional view showing the actuator of FIG. 7, taken along lines VIII-VIII.

Referring to FIGS. 1, 2, 4 and 6, the actuator 200 is held by the housing 100 so as to be pivotable between an open position (see FIG. 4) and a close position (see FIGS. 5 and 6). As can be seen from FIG. 4, according to the present embodiment, the actuator 200 located at the open position is able to be moved to the close position by turning over the actuator 200 toward the front end 102 of the housing 100. As shown in FIG. 7, the actuator 200 according to the present embodiment extends long in the width direction. The actuator 200 is formed with a plurality of slits 210 each of which has opposite walls in the width direction. As shown in FIG. 8, each of the slits 210 is formed with a lift-up portion 220 therewithin. The lift-up portion 220 connects the opposite walls of the slit 210 with each other in the width direction. The lift-up portion 220 is configured to change its position in the vertical direction, which is perpendicular to the width direction, when the actuator 200 pivots between the open position and the close position. More specifically, a position at which the lift-up portion 220 is located when the actuator 200 is located at the close position is higher in the vertical direction than a position at which the lift-up portion 220 is located when the actuator 200 is located at the open position.

Figure 2:
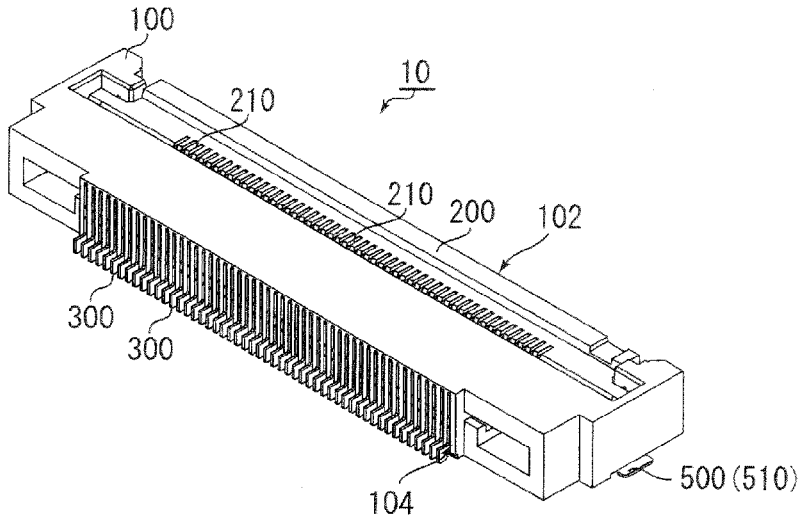
FIG. 2 is a rear oblique view showing the connector of FIG. 1.

Referring to FIGS. 2 and 4, each of the upper contacts 300 is inserted into the housing 100 from the rear end 104 of the housing 100 toward the front end 102 of the housing 100 so that the upper contact 300 is press-fitted into and fixed to the housing 100. In other words, the upper contacts 300 are held by the housing 100.

In detail, the upper contact 300 has an upper arm 310, an upper support portion 330, an upper first fixed portion 350 and an upper second fixed portion 370. The upper support portion 330 supports the upper arm 310. The upper first fixed portion 350 and the upper second fixed portion 370 extend from the upper support portion 330.

The upper arm 310 has an upper pressed portion 314 formed on one of ends thereof and an upper contact portion 318 formed on a remaining one of the ends. The upper pressed portion 314 extends in the slit 210 of the actuator 200 so as to cover the lift-up portion 220 from above. Therefore, the upper pressed portion 314 is lifted up by the lift-up portion 220 when the lift-up portion 220 changes its position upward (i.e. when the actuator 200 pivots from the open position toward the close position). The upper contact portion 318 is configured to be brought into contact with and electrically connected to the upper terminal 62 of the FPC/FFC 50. The upper support portion 330 has opposite ends, namely a first end and a second end. The first end of the upper support portion 330 is connected to a middle part of the upper arm 310 between the upper pressed portion 314 and the upper contact portion 318 so that the upper arm 310 is able to move or swing like a seesaw. Specifically, the upper contact portion 318 moves downward when the upper pressed portion 314 is lifted up by the lift-up portion 220.

The upper first fixed portion 350 extends from the other one of the opposite ends of the upper support portion 330 (i.e. the second end opposite to the first end which supports the upper arm 310) toward the upper pressed portion 314. The upper second fixed portion 370 extends from the second end of the upper support portion 330 toward the upper contact portion 318. As can be seen from the above description, the upper second fixed portion 370 extends in a direction opposite to a direction in which the upper first fixed portion 350 extends. The upper first fixed portion 350 has a short-bar-like shape. The upper first fixed portion 350 is inserted into a hole 112 formed within the housing 100 so that the upper first fixed portion 350 is substantially prevented from moving. In other words, the upper first fixed portion 350 is fixed to the housing 100. The upper second fixed portion 370 has a U-like shape as seen along the width direction. The upper second fixed portion 370 is press-fitted into and fixed to the housing 100. In detail, the upper second fixed portion 370 has a head 372. The head 372 is formed so as to be located at a position opposite to the upper first fixed portion 350 in the vertical direction. The head 372 is inserted into a hole 110 formed within the housing 100 so that the upper second fixed portion 370 is substantially prevented from moving.

Referring to FIGS. 1 and 4, each of the lower contacts 400 is inserted into the housing 100 from the front end 102 of the housing 100 toward the rear end 104 of the housing 100 so that the lower contact 400 is press-fitted into and fixed to the housing 100. In other words, the lower contacts 400 are held by the housing 100.

In detail, the lower contact 400 has a lower arm 410, a lower support portion 430, a lower first fixed portion 450 and a lower second fixed portion 470. The lower support portion 430 supports the lower arm 410. The lower first fixed portion 450 and the lower second fixed portion 470 extend from the lower support portion 430.

The lower arm 410 has a lower pressed portion 414 formed on one of ends thereof and a lower contact portion 418 formed on a remaining one of the ends. The lower pressed portion 414 is arranged so as to face the upper contact portion 318 in the vertical direction. According to the present embodiment, the upper contact portion 318 is located above the lower pressed portion 414. The lower contact portion 418 is configured to be brought into contact with and electrically connected to the lower terminal 72 of the FPC/FFC 50. The lower support portion 430 has opposite ends, namely a first end and a second end. The first end of the lower support portion 430 is connected to a middle part of the lower arm 410 between the lower pressed portion 414 and the lower contact portion 418 so that the lower arm 410 is able to move or swing like a seesaw. Specifically, the lower contact portion 418 moves upward when the lower pressed portion 414 is moved downward.

The lower first fixed portion 450 extends from the other one of the opposite ends of the lower support portion 430 (i.e. the second end opposite to the first end which supports the lower arm 410) toward the lower pressed portion 414. The lower second fixed portion 470 extends from the second end of the lower support portion 430 toward the lower contact portion 418. As can be seen from the above description, the lower second fixed portion 470 extends in a direction opposite to a direction in which the lower first fixed portion 450 extends. The lower first fixed portion 450 has a short-bar-like shape. The lower first fixed portion 450 is press-fitted into and fixed to the housing 100. The lower second fixed portion 470 has a J-like shape as seen along the width direction. The lower second fixed portion 470 is press-fitted into and fixed to the housing 100. In detail, the lower second fixed portion 470 has a press-fitted portion 472 formed with a protrusion 474. On the other hand, the housing 100 is formed with a press-fit groove 106 which is receivable the press-fitted portion 472. The protrusion 474 cuts into an inner wall of the press-fit groove 106 when the press-fitted portion 472 is press-fitted into the press-fit groove 106 so that the press-fitted portion 472 is fixed in the press-fit groove 106. The housing 100 is formed with a held portion 108 on the press-fit groove 106. The press-fitted portion 472 and an opposite part of the lower second fixed portion 470 sandwich and hold the held portion 108 in the vertical direction.

As can be seen from FIG. 4, the upper arm 310 of the upper contact 300 and the lower arm 410 of the lower contact 400 are arranged so as to be able to accommodate the FPC/FFC 50 in a space (accommodating portion 20) formed between the upper arm 310 and the lower arm 410 when the actuator 200 is located at the open position. According to the present embodiment, the FPC/FFC 50 is inserted in the accommodating portion 20 along the fitting/removing direction perpendicular to both the width direction and the vertical direction. In other words, the FPC/FFC 50 is fitted to or removed from the connector 10 along the fitting/removing direction. According to the present embodiment, upper contact portion 318, lower pressed portion 414 and the lower first fixed portion 450 are placed within a common planar region perpendicular to the width direction and are enclosed by the upper second fixed portion 370 in the planar region. In other words, in the fitting/removing direction, the upper contact portion 318 of the upper contact 300, the lower pressed portion 414 of the lower contact 400 and the lower first fixed portion 450 of the lower contact 400 are placed inside of the U-like shape of the upper second fixed portion 370. It may be configured so that (at least) a part of the lower first fixed portion 450 is surrounded by the upper second fixed portion 370. The lower contact portion 418 is arranged to face the lift-up portion 220 in the vertical direction.

As can be seen from FIGS. 1 and 2, the hold-downs 500 are attached to opposite sides of the housing 100 in the width direction, respectively. The hold-down 500 is inserted into the housing 100 from the front end 102 toward the rear end 104 so as to be press-fitted into and fixed to the housing 100.

Figure 9:
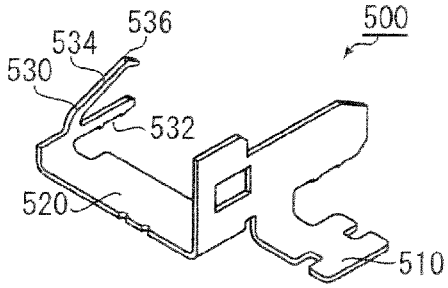
FIG. 9 is a perspective view showing a hold-down of the connector of FIG. 1.

As shown in FIG. 9, the hold-down 500 has a fixed portion 510, a base portion 520 and a ground contact 530. The fixed portion 510 is configured to be fixed to a circuit board (not shown) on which the connector 10 is mounted. For example, the fixed portion 510 is soldered to the circuit board. The ground contact 530 is electrically connected with the fixed portion 510 through the base portion 520. Referring to FIGS. 6 and 9, the ground contact 530 has a body portion 532, an elastic portion 534 having elasticity and a ground contact portion 536. The body portion 532 is press-fitted into and fixed to the housing 100. The elastic portion 534 extends from the body portion 532. The ground contact portion 536 is formed on a tip of the elastic portion 534. The ground contact portion 536 of the ground contact 530 is configured to be connected electrically to the ground terminal 74 of the FPC/FFC 50. The ground contact portion 536 is supported by the elastic portion 534 so as to be movable in the vertical direction. As shown in FIG. 6, the ground contact portion 536 is arranged to face the lift-up portion 220 in the vertical direction.

The connector 10 having the structures as described above is connected to the FPC/FFC 50 in a manner as described below.

The FPC/FFC 50 is inserted into the accommodating portion 20 when the actuator 200 is located at the open position. More specifically, the tip portion 82 of the holding member 80 which holds the FPC/FFC 50 is inserted into the accommodating portion 20 when the actuator 200 is located at the open position so that the FPC/FFC 50 is accommodated in the accommodating portion 20.

The actuator 200 is turned forward so as to be pivoted to the close position in a accommodating state that the FPC/FFC 50 is accommodated in the accommodating portion 20. The upper pressed portion 314 is lifted up by the lift-up portion 220 while the actuator 200 is pivoted.

When the actuator 200 is located at the closed position, the lift-up portion 220 lift up the upper pressed portion 314 to move the upper contact portion 318 downward so that the upper contact portion 318 is brought into contact with and pressed against the upper surface 60 of the FPC/FFC 50. More specifically, the upper contact portions 318 are brought into contact with the respective upper terminals 62 on the upper surface 60 so that the upper contacts 300 is electrically connected to the upper terminals 62, respectively.

The upper contact portions 318 moved downward presses down the lower pressed portion 414 through the FPC/FFC 50. The lower pressed portion 414 pressed downward apply a reaction force to the FPC/FFC 50 upwardly. The upward reaction force keeps the electrical connection between the upper contact 300 and the upper terminal 62 securely.

The FPC/FFC 50 pressed downward by the upper contact portion 318 pushes down the lower pressed portion 414 to move the lower contact portion 418 upward so that the lower contact portions 418 is brought into contact with and pressed against the lower surface 70 of the FPC/FFC 50. More specifically, the lower contact portions 418 are brought into contact with the respective lower terminals 72 on the lower surface 70 so that the lower contacts 400 is electrically connected to the lower terminals 72, respectively.

The lift-up portion 220 receives a downward reaction force from the upper pressed portion 314 when lifting up the upper pressed portion 314. Therefore, the upper pressed portion 314 of the upper contact 300 presses down the actuator 200 when the actuator 200 is located at the close position. A pressing-down force of the actuator 200 pressed by the upper pressed portion 314 of the upper contact 300 keeps the electrical connection between the lower contact 400 and the lower terminal 72 more securely.

Furthermore, the pressing-down force of the actuator 200 pressed by the upper pressed portion 314 more securely connects the ground terminal 74 of the FPC/FFC 50 to the ground contact 530 of the hold-down 500 electrically.

Moreover, both the upper first fixed portion 350 and the upper second fixed portion 370 fix the upper contact 300 to the housing 100 so that the upper contact 300 is more effectively prevented from pivoting even when the upper contact portion 318 moves pivotally on a connecting point of the upper arm 310 with the upper support portion 330. Similarly, both the lower first fixed portion 450 and the lower second fixed portion 470 fix the lower contact 400 to the housing 100 so that the lower contact 400 is more effectively prevented from pivoting even when the lower contact portion 418 moves pivotally on a connecting point of the lower arm 410 with the lower support portion 430. Therefore, the upper contact 300 or the lower contact 400 is unlikely to be removed from the housing 100 unintentionally.

According to the present embodiment, the grooves 84 are formed on the lower surface of the holding member 80. However, it is possible to form the grooves 84 on the upper surface of the holding member 80. Furthermore, it is possible to form the grooves 84 on the both surfaces of the holding member 80. Furthermore, it is possible not to form the grooves 84 at all.

According to the present embodiment, the holding member 80 and the FPC/FFC 50 (connecting object) are configured so that the FPC/FFC 50 is accommodated in the accommodating portion 20 of the connector 10 while being held by the holding member 80. However, the connecting object to the connector 10 is not limited to the FPC/FFC 50 held by the holding member 80. For example, the connecting object may be an ordinary FPC or an ordinary FFC which is not held by the holding member 80.

According to the present embodiment, the FPC/FFC 50 (connecting object) is able to be provided with the upper terminals 62 on the upper surface 60 and the lower terminals 72 on the lower surface 70. Therefore, compared to the case when the terminals (signal lines) are provided on only one of the surfaces of the connecting object, it is possible to increase the number of the terminals (signal lines) of the connecting object about twice.

Moreover, according to the present embodiment, the FPC/FFC 50 (connecting object) is sandwiched between the upper contact 300 and the lower contact 400 so that the upper contact 300 and the lower contact 400 are connected securely to the upper terminal 62 and the lower terminal 72, respectively.

The present application is based on a Japanese patent application of JP2010-183419 filed before the Japan Patent Office on Aug. 18, 2010, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

Which is claimed:

1. A connector configured to be connected to a connecting object having an upper surface and a lower surface, the connector comprising:

a housing;

an actuator held by the housing so as to be pivotable between an open position and a closed position;

an upper contact held by the housing; and a lower contact other than the upper contact, the lower contact being held by the housing;

wherein:

the actuator has a lift-up portion;

the upper contact has an upper arm and an upper support portion;

the upper arm has an upper pressed portion formed on one of ends thereof and an upper contact portion formed on a remaining one of the ends thereof;

the upper support portion is connected to a middle part of the upper arm between the upper pressed portion and the upper contact portion; the lower contact has a lower arm and a lower support portion;

the lower arm has a lower pressed portion formed on one of ends thereof and a lower contact portion formed on a remaining one of the ends thereof;

the lower support portion is connected to a middle part of the lower arm between. the lower pressed portion and the lower contact portion;

the upper contact portion is located above the lower pressed portion;

the upper arm and the lower arm are arranged so as to be able to accommodate the connecting object in an accommodating portion formed therebetween when the actuator is located at the open position; and when the actuator is located at the closed position in a state that the connecting object is accommodated in the accommodating portion, the lift-up portion lifts up the upper pressed portion to move the upper contact portion downward so that the upper contact portion is brought into contact with and pressed against the upper surface of the connecting object, and the connecting object pressed downward by the upper contact portion pushes down the lower pressed portion to move the lower contact portion upward so that the lower contact portion is brought into contact with and pressed against the lower surface of the connecting object.

2. The connector as recited in claim 1, wherein the connecting object is further provided with a ground terminal, and the connector further comprises a hold-down having a ground contact which is configured to be connected to the ground terminal of the connecting object.

3. A connector assembly comprising:

the connector as recited in claim 1;

a connecting object connectable to the connector, the connecting object having an upper surface, a lower surface and a ground terminal; and a holding member configured to hold the connecting object.

4. The connector as recited in claim 1, wherein:

the upper contact is further formed with an upper first fixed portion and an upper second fixed portion;

the upper first fixed portion extends from the upper support portion toward the upper pressed portion while being fixed to the housing;

the upper second fixed portion extends from the upper support portion toward the upper contact portion while being fixed to the housing;

the lower contact is further formed with a lower first fixed portion and a lower second fixed portion;

the lower first fixed portion extends from the lower support portion toward the lower pressed portion while being fixed to the housing; and the lower second fixed portion extends from the lower support portion toward the lower contact portion while being fixed to the housing.

5. The connector as recited in claim 4, wherein:

the lower second fixed portion of the lower contact has a J-like shape as seen along a width direction of the connector.

6. The connector as recited in claim 4, wherein:

the upper second fixed portion of the upper contact has a U-like shape as seen along a width direction of the connector; and in a fitting/removing direction of the connecting object, the upper contact portion of the upper contact and the lower pressed portion of the lower contact are placed inside of the U-like shape.

7. The connector as recited in claim 6, wherein:

at least a part of the lower first fixed portion of the lower contact, is placed inside of the U-like shape.

* * * * *

UNITED STATES PATENT AND TRADEMARK OFFICE

CERTIFICATE OF CORRECTION

PATENT NO. : 8,337,226 B2
APPLICATION NO. : 13/211573
DATED : December 25, 2012
INVENTOR(S) : Hiroyuki Yokoo It is certified that error appears in the above-identified patent and that said Letters Patent is hereby corrected as shown below:

In the Claims:

Column 8, Line 21 (Claim 1, Line 25);

delete "between." and insert --between--.

Column 10, Line 7 (Claim 7, Line 3);

delete "contact," and insert --contact--.

Signed and Sealed this
Thirtieth Day of April, 2013

Teresa Stanek Rea
*Acting Director of the United States Patent and Trademark Office*